US010550732B2

(12) United States Patent
Bailey et al.

(10) Patent No.: US 10,550,732 B2
(45) Date of Patent: Feb. 4, 2020

(54) ENERGY STORAGE

(71) Applicant: Highview Enterprises Limited, London (GB)

(72) Inventors: Chris Bailey, London (GB); Stephen Gareth Brett, Reading (GB); Stuart Nelmes, Windsor (GB)

(73) Assignee: Highview Enterprises Limited, London (GB)

( * ) Notice: Subject to any disclaimer, the term of this patent is extended or adjusted under 35 U.S.C. 154(b) by 242 days.

(21) Appl. No.: 15/577,434

(22) PCT Filed: May 27, 2016

(86) PCT No.: PCT/GB2016/051571

§ 371 (c)(1),
(2) Date: Nov. 28, 2017

(87) PCT Pub. No.: WO2016/189335

PCT Pub. Date: Dec. 1, 2016

(65) Prior Publication Data

US 2018/0163574 A1 Jun. 14, 2018

(30) Foreign Application Priority Data

May 28, 2015 (GB) ..... 1509206.7
Oct. 23, 2015 (GB) ..... 1518849.3

(51) Int. Cl.
*F01K 25/10* (2006.01)
*F01K 25/04* (2006.01)
(Continued)

(52) U.S. Cl.
CPC ..... *F01K 25/10* (2013.01); *F01K 3/16* (2013.01); *F01K 13/02* (2013.01); *F01K 25/04* (2013.01)

(58) Field of Classification Search
CPC ..... F01K 25/10; F01K 25/04; F01K 13/02; F01K 3/16; F01K 25/08; F01K 7/16; F01K 23/18; F01K 23/14
See application file for complete search history.

(56) References Cited

U.S. PATENT DOCUMENTS

2012/0216520 A1* 8/2012 Chen ..... F03G 7/06 60/412
2014/0245756 A1* 9/2014 Morgan ..... F02C 1/04 62/50.1

(Continued)

FOREIGN PATENT DOCUMENTS

GB 2 494 400 A 3/2013
GB 2 509 740 A 7/2014

(Continued)

OTHER PUBLICATIONS

International Search Report for PCT/GB2016/051571 dated Oct. 6, 2016.
International Written Opinion for PCT/GB2016/051571 dated Oct. 6, 2016.

*Primary Examiner* — Mark A Laurenzi
*Assistant Examiner* — Shafiq Mian
(74) *Attorney, Agent, or Firm* — Thomas B. Ryan; Harter Secrest & Emery LLP

(57) ABSTRACT

A cryogenic energy storage system comprising a liquefaction apparatus for liquefying a gas to form a cryogen, wherein the liquefaction apparatus is controllable to draw power from an external power source to liquefy the gas, a cryogenic storage tank in fluid communication with the liquefaction apparatus for storing cryogen produced by the liquefaction apparatus, a power recovery apparatus in fluid communication with the cryogenic storage tank for recovering power from cryogen from the cryogenic storage tank by heating the cryogen to form a gas and expanding said gas, a hot thermal store for storing hot thermal energy, wherein (Continued)

the hot thermal store and the power recovery apparatus are arranged so that hot thermal energy from the hot thermal store can be transferred to the gas before and/or during expansion in the power recovery apparatus, and a charging apparatus which is controllable to draw power from the external power source when the power drawn by the liquefaction apparatus is below a threshold value, and supply the cryogenic energy storage system with thermal energy.

19 Claims, 3 Drawing Sheets

(51) Int. Cl.
*F01K 13/02* (2006.01)
*F01K 3/16* (2006.01)

(56) References Cited

U.S. PATENT DOCUMENTS

2015/0113940 A1* 4/2015 Sinatov ..... F01K 3/02
60/39.182
2015/0226094 A1 8/2015 Alekseev
2016/0178129 A1* 6/2016 Chen ..... F01D 15/005
62/50.3

FOREIGN PATENT DOCUMENTS

WO 2012/095636 A2 7/2012
WO 2014/019698 A2 2/2014
WO 2015/138817 A1 9/2015

* cited by examiner

ENERGY STORAGE

FIELD OF THE INVENTION

The invention relates to an energy storage system and method, particularly a thermal energy storage system and method, and more particularly a cryogenic energy storage system and method.

BACKGROUND OF THE INVENTION

Electricity transmission and distribution networks (or grids) must balance the generation of electricity with demand from consumers. At present, this is normally achieved by modulating a generation side (supply side) of the network by turning power stations on and off and/or running some power stations at reduced load. As most existing thermal and nuclear power stations are most efficient when run continuously at full load, balancing the supply side in this way results in an efficiency penalty. It is expected that significant intermittent renewable generation capacity, such as wind turbines and solar collectors, will soon be introduced to the networks, and this will further complicate the balancing of the grids by creating uncertainty in the availability of portions of the generation side.

Power storage devices and systems typically have three phases of operation: charge, store and discharge. Power storage devices typically generate power (discharge) on a highly intermittent basis when there is a shortage of generating capacity on the transmission and distribution networks. This can be signalled to the storage device operator by a high price for electricity in the local power market or by a request from the organisation responsible for the operating of the network for additional capacity. In some countries, such as the United Kingdom, the network operator enters into contracts for the supply of back-up reserves to the network with operators of power plants with rapid start capability. Such contracts can cover months or even years, but typically the time the power provider will be operating (generating power) is very short. In addition, a storage device can provide an additional service in providing additional loads at times of oversupply of power to the grid from intermittent renewable generators. Wind speeds are often high overnight when demand is low. The network operator must either arrange for additional demand on the network to utilise the excess supply, through low energy price signals or specific contracts with consumers, or constrain the supply of power from other stations or the wind farms. In some cases, especially in markets where wind generators are subsidised, the network operator will have to pay the wind farm operators to 'turn off' the wind farm. A storage device offers the network operator a useful additional load that can be used to balance the grid in times of excess supply.

For a storage system or device to be commercially viable the following factors are important: capital cost per MW (power capacity), capital cost per MWh (energy capacity), round trip cycle efficiency and lifetime with respect to the number of charge and discharge cycles that can be expected from the initial investment. For widespread utility scale applications it is also important that the storage device is geographically unconstrained i.e. it can be built anywhere, in particular next to a point of high demand or next to a source of intermittency or a bottleneck in the transmission and distribution network.

One such storage device technology is the storage of energy using a cryogen (Liquid Air Energy Storage (LAES)), such as liquid air or liquid nitrogen, which offers a number of advantages in the market place. Broadly speaking a LAES system would typically, in the charge phase, utilise low cost or surplus electricity, at periods of low demand or excess supply from intermittent renewable generators, to liquefy a working fluid such as air or nitrogen during a first liquefaction phase. This is then stored as a cryogenic fluid in a storage tank during a storage phase, and subsequently released to drive a turbine, producing electricity during a discharge, or power recovery, phase, at periods of high demand or insufficient supply from intermittent renewable generators.

LAES systems are predominantly mechanically based, with the main system components being turbo-expanders, compressors and pumps. Although these components can deliver response times of a few minutes, the response is not typically instantaneous.

LAES systems often include thermal storage to store the heat produced by the compressors used in the refrigeration cycle required to charge the system. This heat is then used to superheat the working fluid (i.e. cryogen) during the power recovery phase, increasing the amount of energy that may be recovered. Waste heat may also be stored from a co-located process.

During the storage phase, although the thermal storage is thermally insulated, heat egress occurs, causing a small portion of the thermal energy to be lost to the surrounding environment.

It would therefore be advantageous to improve the instantaneous response of a LAES system while also mitigating the effects of heat egress from the thermal storage and supplying further heat for increasing the output of the LAES system.

SUMMARY OF THE INVENTION

In accordance with a first aspect of the invention, there is provided a cryogenic energy storage system comprising:

- a liquefaction apparatus for liquefying a gas to form a cryogen, wherein the liquefaction apparatus is controllable to draw power from an external power source to liquefy the gas;
- a cryogenic storage tank in fluid communication with the liquefaction apparatus for storing cryogen produced by the liquefaction apparatus;
- a power recovery apparatus in fluid communication with the cryogenic storage tank for recovering power from cryogen from the cryogenic storage tank by heating the cryogen to form a gas and expanding said gas;
- a hot thermal store for storing hot thermal energy, wherein the hot thermal store and the power recovery apparatus are arranged so that hot thermal energy from the hot thermal store can be transferred to the high-pressure gas before and/or during expansion in the power recovery apparatus; and
- a charging apparatus which is controllable to draw power from the power recovery apparatus when the power that is recovered by the power recovery apparatus is above a threshold value, and supply the cryogenic energy storage system with thermal energy.

The power recovery apparatus may comprise a pump for pressurising the cryogen before the cryogen is heated to form a gas. The power recovery apparatus may be for recovering power from the cryogenic storage tank by pressurising the cryogen with the pump, heating the cryogen to form a gas and expanding said gas. The power recovery apparatus typically recovers power from cryogen from the cryogenic storage tank by pumping the cryogen to high pressure, heating the high-pressure cryogen to form a high-pressure gas and expanding said high-pressure gas.

The word "external" in the term "external power source" refers to a power source external to the cryogenic energy storage system.

The charging apparatus may be controllable to draw power from the power recovery apparatus when the power that is recovered by the power recovery apparatus is greater than a required power output of the system. The power drawn by the charging apparatus from the power recovery apparatus may be equal to or less than the power recovered by the power recovery apparatus.

The threshold value may be a second threshold value, and the charging apparatus may be controllable to draw power from the external power source when the power drawn by the liquefaction apparatus is below a first threshold value, and supply the cryogenic energy storage system with thermal energy.

In accordance with another aspect of the invention, there is provided a cryogenic energy storage system comprising:

- a liquefaction apparatus for liquefying a gas to form a cryogen, wherein the liquefaction apparatus is controllable to draw power from an external power source to liquefy the gas;
- a cryogenic storage tank in fluid communication with the liquefaction apparatus for storing cryogen produced by the liquefaction apparatus;
- a power recovery apparatus in fluid communication with the cryogenic storage tank for recovering power from cryogen from the cryogenic storage tank by heating the cryogen to form a gas and expanding said gas;
- a hot thermal store for storing hot thermal energy, wherein the hot thermal store and the power recovery apparatus are arranged so that hot thermal energy from the hot thermal store can be transferred to the high-pressure gas before and/or during expansion in the power recovery apparatus; and
- a charging apparatus which is controllable to draw power from the external power source when the power drawn by the liquefaction apparatus is below a threshold value, and supply the cryogenic energy storage system with thermal energy.

The power recovery apparatus may comprise a pump for pressurising the cryogen before the cryogen is heated to form a gas. The power recovery apparatus may be for recovering power from the cryogenic storage tank by pressurising the cryogen with the pump, heating the cryogen to form a gas and expanding said gas. The power recovery apparatus typically recovers power from cryogen from the cryogenic storage tank by pumping the cryogen to high pressure, heating the high-pressure cryogen to form a high-pressure gas and expanding said high-pressure gas;

The threshold value may be a first threshold value, and the charging apparatus may be controllable to draw power from the power recovery apparatus when the power that is recovered by the power recovery apparatus is above a second threshold value, and supply the cryogenic energy storage system with thermal energy.

It will be understood by the skilled person that the power that is recovered by the power recovery apparatus may be subject to normal parasitic loads necessary for the operation of the cryogenic energy storage system (for example, power to pumps, fans, the control system etc.). The skilled person will understand that the "power recovered by the power recovery system" is the power that is available for output (e.g. to an external process or electrical grid) once any normal losses have been subtracted. The recurrent term "external process" refers to a system external to the cryogenic energy storage system.

The charging apparatus may be controllable to draw power from the external power source and/or from the power recovery apparatus substantially instantaneously. The charging apparatus may be controllable electronically.

The cryogen may be liquid air or liquid nitrogen. The system may be a liquid air energy storage (LAES) system. The gas produced by applying heat to the cryogen in the power recovery apparatus may be a high-pressure gas (e.g. cryogen which has been pumped to a high pressure and then heated to become a gas).

Thermal energy generated by the liquefaction apparatus and/or a co-located process may be transferrable to the thermal store. The co-located process may be any independent process that produces thermal energy which is transferrable to the thermal store, such as a burner or a thermal power plant (e.g. gas turbine). The term "co-located process" thus refers to a system co-located with and external to the cryogenic energy storage system, e.g. power plants, manufacturing plants, data centers.

The threshold(s) may be variable or constant, during a given period of time (for example several days, hours, minutes or seconds or sub-second). The power drawn by the charging apparatus may be variable or constant, during a given period of time. Additionally or alternatively, the power drawn by the liquefaction apparatus may be variable or constant, during a given period of time. The power drawn by the charging apparatus from the power recovery apparatus may be equal to or less than the power that is recovered by the power recovery apparatus.

The liquefaction apparatus may comprise a compressor for compressing gas in a refrigeration cycle for producing the cryogen.

The power recovery apparatus may comprise an expander for expanding the gas.

The charging apparatus may comprise a load bank. In other words, the charging apparatus may comprise a resistive component, such as a resistive coil or a resistive wire. Alternatively, the charging apparatus may comprise a battery.

The thermal store may utilise a heat transfer fluid, such as hot water or hot oil. The thermal store may comprise one thermal storage vessel, at least one thermal storage vessel, or a plurality of thermal storage vessels. The thermal storage vessel(s) may contain the heat transfer fluid.

The charging apparatus may be configured to dissipate power generated by the power recovery apparatus when the power recovery apparatus is disconnected from an external power sink due to an abnormal event.

The system may further comprise a cold thermal storage system for storing cold recovered from the evaporation of cryogen to form gas and for transferring said cold to the liquefaction apparatus in order to reduce the energy requirements of liquefaction within the liquefaction apparatus.

There is also provided a method of storing energy comprising:

- providing a cryogenic energy storage system comprising:
  - a liquefaction apparatus for liquefying a gas to form a cryogen, wherein the liquefaction apparatus is controllable to draw power from an external power source to liquefy the gas;
  - a cryogenic storage tank in fluid communication with the liquefaction apparatus for storing cryogen produced by the liquefaction apparatus;

a power recovery apparatus in fluid communication with the cryogenic storage tank for recovering power from cryogen from the cryogenic storage tank by heating the cryogen to form a gas and expanding said gas;

a hot thermal store for storing hot thermal energy, wherein the hot thermal store and the power recovery apparatus are arranged so that hot thermal energy from the hot thermal store can be transferred to the gas before and/or during expansion in the power recovery apparatus; and a charging apparatus which is controllable to draw power from the power recovery apparatus when the power that is recovered by the power recovery apparatus is above a threshold value, and supply the cryogenic energy storage system with thermal energy.

There is also provided a method of storing energy comprising:

providing a cryogenic energy storage system comprising:

a liquefaction apparatus for liquefying a gas to form a cryogen, wherein the liquefaction apparatus is controllable to draw power from an external power source to liquefy the gas;

a cryogenic storage tank in fluid communication with the liquefaction apparatus for storing cryogen produced by the liquefaction apparatus;

a power recovery apparatus in fluid communication with the cryogenic storage tank for recovering power from cryogen from the cryogenic storage tank by heating the cryogen to form a gas and expanding said gas;

a hot thermal store for storing hot thermal energy, wherein the hot thermal store and the power recovery apparatus are arranged so that hot thermal energy from the hot thermal store can be transferred to the gas before and/or during expansion in the power recovery apparatus; and a charging apparatus which is controllable to draw power from the external power source when the power drawn by the liquefaction apparatus is below a threshold value, and supply the cryogenic energy storage system with thermal energy.

The power recovery apparatus may comprise a pump, and the method may further comprise pressurising the cryogen using the pump before heating the cryogen to form a gas.

The present invention provides a system and method for storing energy during periods of low demand for later use during periods of high demand, or during low output from intermittent generators. This is hugely beneficial in balancing an electrical grid and providing security of electrical power supply.

A problem with known energy storage systems (e.g. cryogenic energy storage systems) is that the loading profile of the system is often limited by the design of the system, particularly the mechanical equipment within known liquefaction and power recovery apparatuses (e.g. compressors and turbo-expanders). The invention comprises a charging apparatus (e.g. load bank or load bank system), such as an electrical heating device located in the thermal store, which can be instantaneously or substantially instantly loaded providing heat for the thermal store, which can be subsequently used in the power recovery cycle of the LAES system.

The loading of the charging apparatus can be modulated in conjunction with the rate at which the mechanical equipment is loaded during the start-up of the liquefaction apparatus during the liquefaction phase so that the overall LAES charging load remains constant. In this way, the LAES system may be used to provide fast acting frequency response, somewhat similar to "Demand Side Response".

Another benefit of the invention is that the loading of the charging apparatus (e.g. heating device) can be modulated to follow the fluctuating supply of intermittent renewable generation sources, such as wind farms or solar farms. The heating device may be loaded instantaneously in response to a rise in the supply from the power generation source and unloaded instantaneously in response to a drop in supply from the power generation source.

Yet another benefit of the invention is that a portion of the power that is recovered by the power recovery apparatus may be dissipated in the charging apparatus and said portion can be modulated in response to frequency fluctuations on the electrical grid during power recovery so that the power exported to the grid may be modulated faster than would be possible within the rate of response of the mechanical equipment of the power recovery apparatus (e.g. turbo-expander). In this way, the LAES system may be used to provide fast acting generation "Frequency Response".

Further utility may be derived from the charging apparatus (e.g. heating device) to act as a brake for the LAES electrical generator(s) used during system discharge. Because the charging apparatus can act instantaneously, it may be employed as an over-speed protection system in place of the mechanical systems normally deployed to remove shaft power from the prime mover driving the generator when the generator circuit breaker trips unexpectedly.

BRIEF DESCRIPTION OF THE DRAWINGS

The invention will now be described with reference to the accompanying drawings in which.

DETAILED DESCRIPTION OF THE DRAWINGS

Figure 1:
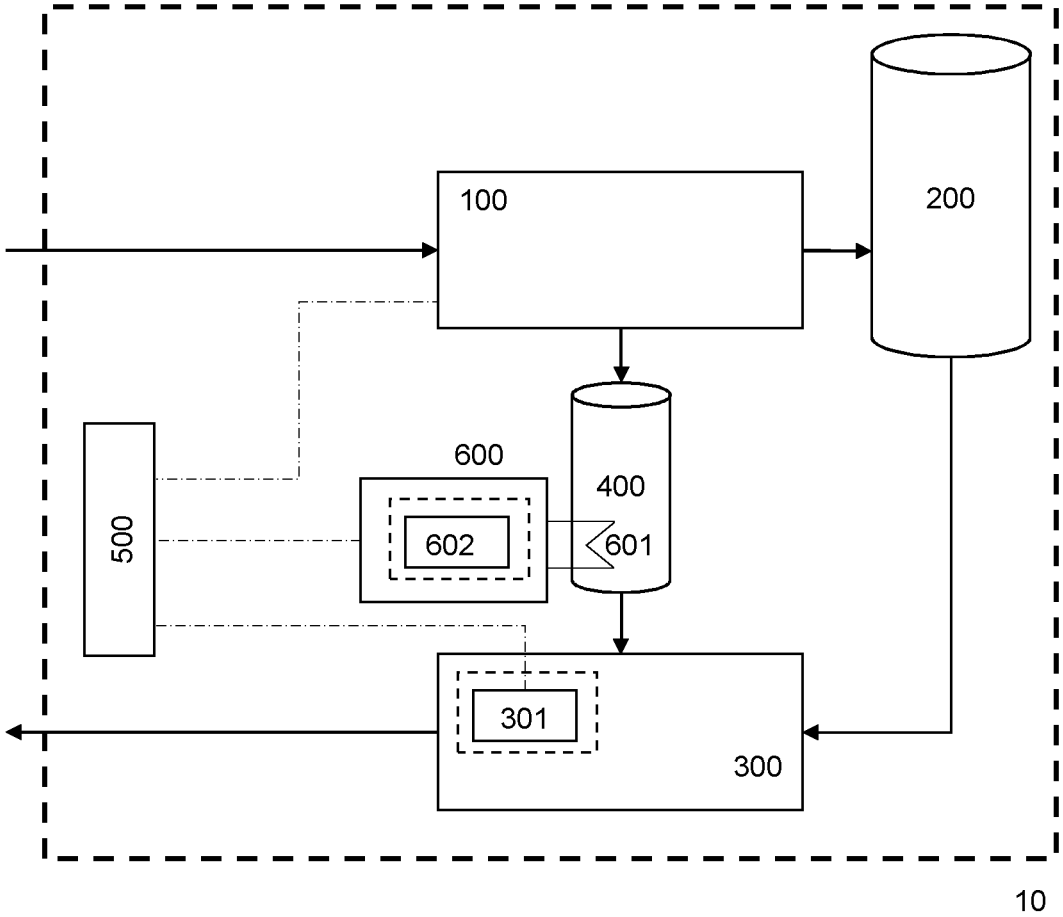
FIG. 1 shows a schematic view of a cryogenic energy storage system according to an embodiment of the invention.

FIG. 1 illustrates a cryogenic energy storage system 10 according to an embodiment of the invention, more particularly a LAES system. The system 10 employs the use of a cryogen (e.g. liquid air or liquid nitrogen) as described in detail herein.

Liquefaction (i.e. charging) processes for LAES systems are known in the art and have in common the use of compression means, which generate heat (as is known by the skilled person). Likewise, power recovery (i.e. discharging) processes for LAES systems are known in the art and have in common the use of expansion means (e.g. turbo-expanders or reciprocating expanders), which may benefit from the addition of heat to increase power output (as is known by the skilled person).

The system 10 shown in FIG. 1 comprises a liquefaction apparatus 100 for liquefying a gas to form a cryogen, a cryogenic storage tank 200 in fluid communication with the liquefaction apparatus 100 for storing cryogen produced by the liquefaction apparatus 100, a power recovery apparatus 300 in fluid communication with the cryogenic storage tank 200 for recovering power from cryogen from the cryogenic storage tank 200 by heating the cryogen to form a high-pressure gas (e.g. cryogen which has been pumped to a high pressure and then heated to become a gas) and expanding the high-pressure gas, and a hot thermal store 400 for storing hot thermal energy. The thermal store 400 and the power recovery apparatus 300 are arranged so that hot thermal energy from the thermal store can be transferred to the high-pressure gas before and/or during expansion in the power recovery apparatus 300.

The system 10 also comprises an electrical distribution panel 500 and is connected to a power distribution network, such as an electricity grid, or any suitable external power source and power sink. The power recovered by the power recovery apparatus 300 is typically supplied to an external power sink (e.g. back into the power distribution network).

The liquefaction apparatus 100, or liquefaction plant, is controllable to draw power from the external power source (e.g. power distribution network) to liquefy gas to produce the cryogen. However, the load profile of traditional liquefaction apparatuses is limited by the mechanical equipment (e.g. compressors) within the liquefaction apparatus. Therefore, advantageously, the system 10 also comprises a charging apparatus 600. The charging apparatus 600 is controllable to draw power from the external power source when the power drawn by the liquefaction apparatus 100 is below a threshold value, and supply the cryogenic energy storage system 10 with thermal energy. The threshold value may be a predetermined value, or it may be based on real-time measured values. The threshold value may also vary with time. The charging apparatus 600 may also be controllable to draw power from the external power source when the liquefaction apparatus 100 is drawing no power at all. Suitable control means for controlling the power drawn by the liquefaction apparatus 100 and/or the charging apparatus 600 are known in the art and will be understood by the skilled person. Suitable control means for controlling the power drawn by the liquefaction apparatus 100 may comprise a variable frequency drive to control the rotational speed of one or all of the compressors of said apparatus or inlet guide vanes to control the mass flow through said compressor. Further control methods known in the art may be employed to ensure that the ancillary equipment is operating at the appropriate operating point given the operating point of said compressor.

Suitable control means for controlling the power drawn by the charging apparatus 600 may comprise power electronics such as an inverter to control the power supplied to the heating element 601, or the commutation of a number of discrete heating elements.

The charging apparatus 600 is, additionally or alternatively, controllable to draw power from the power recovery apparatus 300 when the power that is recovered by the power recovery apparatus is above a threshold value (e.g. when the power that is recovered by the power recovery apparatus is greater than a required power output of the system, such as the power required by an external process or electrical grid), and supply the cryogenic energy storage system 10 with thermal energy. Suitable control means for controlling the power supplied by the power recovery apparatus 300 and/or the power drawn by the charging apparatus 600 are known in the art and will be understood by the skilled person. Suitable control means for controlling the power supplied by the power recovery apparatus 300 may comprise a variable frequency drive to control the rotational speed of the cryogen pump of said apparatus.

Further control methods known in the art may be employed to ensure that the ancillary equipment is operating at the appropriate operating point given the operating point of said cryogenic pump.

Suitable control means for controlling the power drawn by the charging apparatus 600 may comprise power electronics such as an inverter to control the power supplied to the heating element 601, or the commutation of a number discrete heating elements.

As described previously, it will be understood by the skilled person that the power that is recovered by the power recovery apparatus may be subject to normal parasitic loads necessary for the operation of the cryogenic energy storage system (for example, power to pumps, fans, the control system etc.). The skilled person will understand that the "power recovered by the power recovery system" is the power that is available for output (e.g. to an external process or electrical grid) once any normal losses have been subtracted. The term "electrical grid" encompasses any electrical network to which the LAES system is connected, including distribution and transmission networks.

In the embodiment shown in FIG. 1, the charging apparatus 600 comprises a load bank system comprising a heating element 601. The heating element 601 typically comprises a resistive component, such as a resistive coil or wire, situated within the thermal store 400 and connected to a variable frequency drive. Alternatively, the heating element may comprise a plurality of coils or wires. Alternatively, the heating element may be situated outside the thermal store 400 and connected to it by pipes and at least one pump to transport heat in a heat transfer fluid from the heating element to the thermal store. The load bank system also comprises a power and control unit 602. A similar advantage in terms of instantaneous loading may be achieved using a charging system comprising a battery system, the difference being that the energy drawn by the battery system would be stored as chemical energy instead of thermal energy, and would be recovered as electrical energy directly, rather than by augmenting the power output of the power recovery system. It is contemplated that this may form an inventive concept.

During the liquefaction or charging phase, air from ambient is liquefied in the liquefaction apparatus 100 and the resulting liquid air is conveyed to the cryogenic storage tank 200. Heat generated by compressors in the liquefaction apparatus 100 is recovered and stored in the hot thermal store 400. Means for recovering and storing hot thermal energy are known in the art and will be understood by the skilled person. Means for recovering hot thermal energy may comprise a heat transfer fluid, a heat exchanger and a pump to recirculate the heat transfer fluid within a thermal recovery loop. Means for storing hot thermal energy may comprise a thermally-insulated pressure vessel and a thermal storage medium. The thermal recovery loop may comprise a heat transfer fluid, a heat exchanger, a pump to recirculate the heat transfer fluid, a thermally-insulated pressure vessel and a thermal storage medium. The heat transfer fluid may be used as a thermal storage medium. The heat transfer fluid may preferably display a high specific heat capacity, which may be comprised between 2 and 5 $kJ \cdot kg^{-1} \cdot K^{-1}$. The heat transfer fluid may preferably remain in a liquid state under the temperature and pressure conditions applied in the thermal recovery loop at all times, i.e, whenever power from the external power source or from the power recovery apparatus 300 is drawn or not drawn by the charging apparatus 600. Typically, hot water is used as a thermal storage medium and/or a heat transfer fluid and is pumped around a thermal recovery loop and stored in a thermally insulated tank. Hot oil can also be used as a thermal storage medium and/or a heat transfer fluid in the thermal store 400. A mixture comprising water and glycol could also be used as a thermal storage medium and/or heat transfer fluid. The temperature of the heat or hot thermal energy recovered from the liquefaction apparatus 100 depends upon the design of the system, but may typically range between 60° C. and 200° C.

During the power recovery or discharging phase, liquid air flows from the cryogenic storage tank 200 to the power recovery apparatus 300 where it is pumped to high pressure and expanded using an expansion means (e.g. one or more turbine(s), one or more multi-stage expansion turbines) to recovery energy. Suitable expansion means are known in the art and will be understood by the skilled person. The heat stored in the hot thermal store 400 is supplied to the power recovery apparatus 300 to increase the temperature of the air prior to expansion and increase the power output of the power recovery apparatus 300. The mechanical power generated by the turbines in the power recovery apparatus 300 is converted into electrical power by an alternator 301 and delivered to the external power sink (e.g. electricity network) where there is a demand for power.

Figure 2:
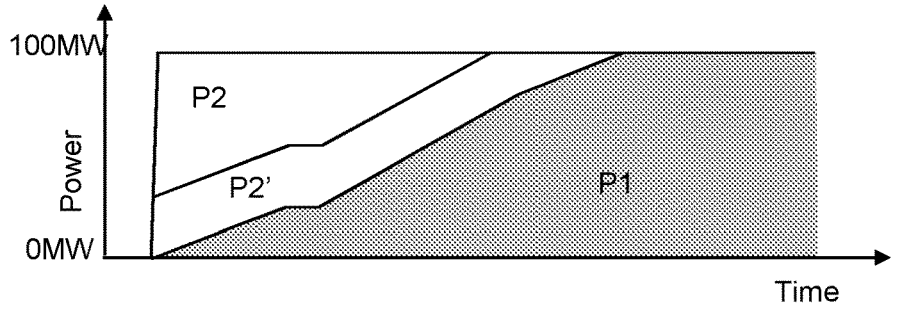
FIG. 2 shows load profiles of a cryogenic energy storage system according to an embodiment of the invention.

During the startup sequence of the liquefaction apparatus 100, the mechanical equipment in the liquefaction apparatus 100, which primarily comprises compressors and pumps, is powered up to operating point over a finite period of time. An example of a load profile of the liquefaction apparatus 100 during the startup sequence is shown in FIG. 2, where the total load of the liquefaction apparatus 100 is depicted by the shaded area marked P1. The power drawn by the liquefaction apparatus 100 ramps up over a number of minutes, typically 2 to 10 minutes, from zero to the maximum load of liquefaction apparatus 100. In the example shown in FIG. 2, the maximum load of the liquefaction apparatus 100 is 100 MW. However, the skilled person will understand that any suitable maximum load can be used.

The load of the liquefaction apparatus 100 is measured by the electrical distribution panel 500 and the power and control unit 602 of the load bank system 600 is controlled to draw an amount of power that is the same as the difference between the actual load drawn by the liquefaction apparatus 100 and the maximum load of the liquefaction apparatus 100 (the difference arising due to the delayed response of the charging of the mechanical equipment in the liquefaction apparatus 100). For example, for a maximum liquefaction apparatus 100 power rating of 100 MW, if the liquefaction apparatus 100 is approximately half way through its startup sequence and is drawing approximately 40 MW of power (as shown in FIG. 2), the load bank system 600 is controlled to draw 60 MW of power and the total power drawn by the system 10 from the electricity network is 100 MW.

The power drawn by the load bank system 600 is used to supply the heating element 601, and is dissipated as heat into the hot thermal energy store 400. Exemplary additional loads of the load bank system 600 are depicted by the areas marked P2 and P2' in FIG. 2. It will be recognised that a very large 100 MW load bank system would be required to provide an instantaneous response at full load when the startup operation is initiated; this is shown as P2 in FIG. 2. As an alternative, a smaller load bank system 600 could be used. While such a smaller load bank system 600 could not provide an instantaneous response at the full maximum load of the liquefaction apparatus 100, it could still provide a fast initial startup at a partial load, as depicted by the area marked P2' in FIG. 2. This compromise can offer an advantageous solution to the problem of providing an instantaneous response at an acceptable load whilst avoiding the need to provide a very large load bank system 600 which could be costly and space-consuming.

As shown in FIG. 2, in embodiments where the load bank system 600 is large enough to provide an instantaneous response at full load when the startup operation is initiated, the net effect of the load drawn by the liquefaction apparatus 100 and the load drawn by the load bank system 600 is a constant, substantially constant or near-constant load profile. In such cases, since the load bank system 600 may be instantaneously, substantially instantaneously or near-instantaneously ramped to full load, the overall loading of the LAES system is also instantaneous, substantially instantaneous or near-instantaneous. However, even if a smaller load bank system 600 is used (as described above and shown by the area marked P2' in FIG. 2), the overall instantaneous response of the system 10 is significantly improved over a system with no load bank system 600.

A 100 MW liquefaction apparatus is used as an example for the purposes of illustration. However, the sizing of the liquefaction apparatus is a decision to be taken by the designer for a specific application, as is the size of the load bank system in relation to the liquefaction apparatus. The skilled person will understand how to choose system components of a suitable size.

The power drawn by the load bank system 600 is controlled by means known by the skilled person, for example a variable frequency drive, or a commutation of a number discrete heating elements.

The heat dissipated into thermal store 400 by the load bank system supplements the heat supplied by the liquefaction apparatus 100.

Figure 3:
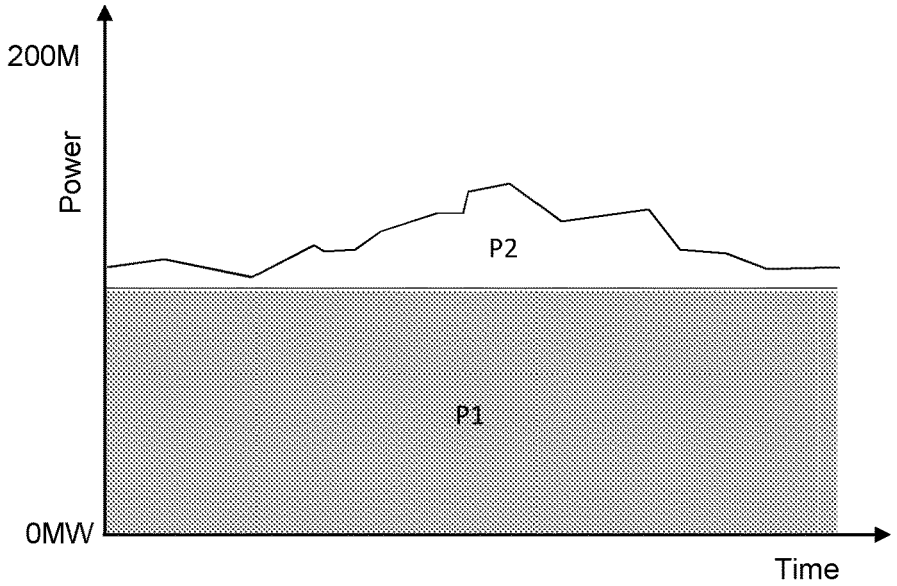
FIG. 3 shows a first exemplary operation of a cryogenic energy storage system according to an embodiment of the invention.

FIG. 3 illustrates a first exemplary operation of an embodiment of the invention in the liquefaction phase to follow fluctuating supply from intermittent wind generation. In this mode of operation, the liquefaction apparatus 100 operates at a constant 100 MW (full load) during a period of high wind. Charging apparatus 600 is controlled to consume the difference between the wind generation and the load of liquefaction apparatus 100 so that the overall load of the system matches, or remains within, the supply available from the wind generation.

Figure 4:
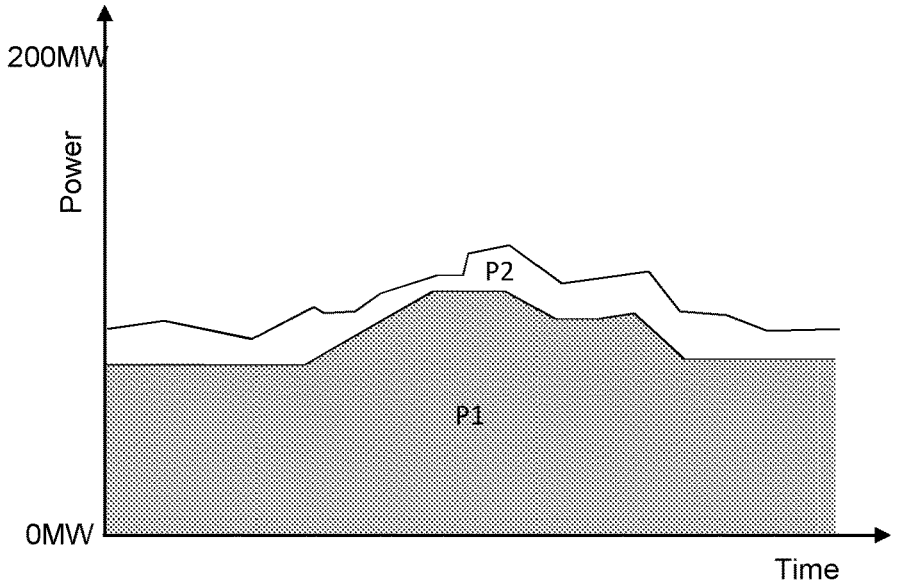
FIG. 4 shows a second exemplary operation of a cryogenic energy storage system according to an embodiment of the invention.

FIG. 4 illustrates a second exemplary operation of an embodiment of the invention in the liquefaction phase to follow fluctuating supply from intermittent wind generation. In this operation, the liquefaction apparatus 100 load is modulated similarly to the charging apparatus 600 load.

The liquefaction apparatus 100 is operated to provide slow control of the load drawn by the LAES system and the load bank system 600 is operated to provide fast control. In this mode of operation, the liquefaction apparatus 100 is modulated across a set margin below a setpoint, for example from 50% of the maximum load of load bank system 600 up to the maximum load of the liquefaction apparatus 100. The mechanical (e.g. rotating) equipment of the liquefaction apparatus 100 is slow in comparison to the load bank system 600 to react to a changing setpoint and therefore only comparatively slow control of the liquefaction apparatus 100 is possible. In contrast, the load bank system 600 is controlled and powered electrically and therefore may be finely and almost instantaneously modulated to achieve the desired setpoint (fast control).

Whilst the above principles have been described in conjunction with power supply from a wind farm, the invention may equally be applied to other fluctuating (e.g. renewable) power sources such as wave, tide or solar energy farms.

Similar advantages may be derived during the power recovery phase, but in response to fluctuating demand from the electricity network rather than fluctuating generation. The power recovery apparatus of the LAES plant is composed of mechanical equipment—the primary component is typically a turbo-expander generator. When operating in response to fluctuating power signals from the grid (either an externally provided power set point or in response to changes in the grid frequency), the power recovery apparatus is controlled to provide more or less power. In conventional systems, this can only typically be achieved in a few seconds. With the increasing penetration of renewables into the electricity network and a forecast reduction in the inertia of the network, new requirements have been identified for sub-second response to frequency deviations.

Figure 5:
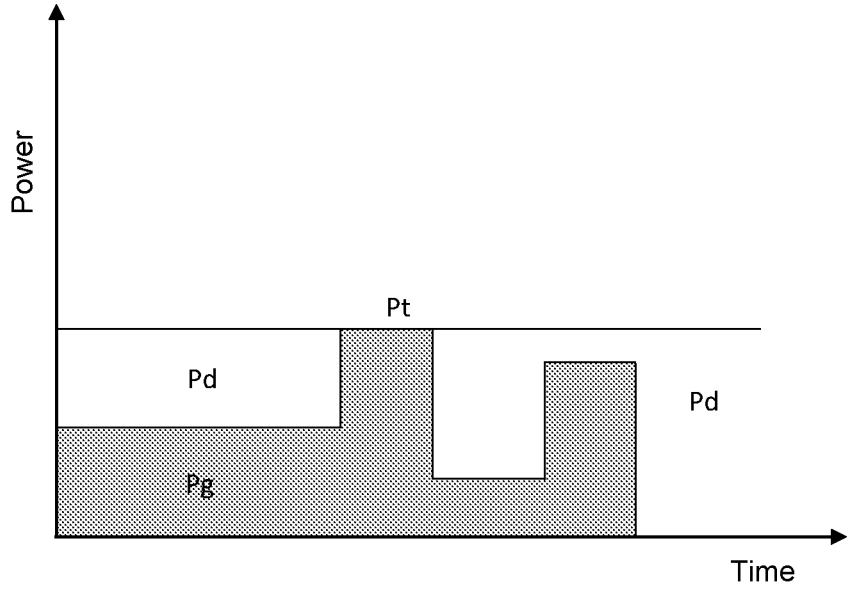
FIG. 5 shows a third exemplary operation of a cryogenic energy storage system according to an embodiment of the invention.

FIG. 5 illustrates an exemplary operation of an embodiment of the invention in the power recovery phase to follow fluctuating load on the electricity network. In this mode of operation, the power recovery apparatus 300 recovers power at a net power output Pt, shown here as constant (for example, 50 MW). Charging apparatus 600 is controllable to consume a portion Pd of the power recovered by the power recovery apparatus 300 and the remaining power Pg is exported to the grid. Portion Pt is substantially converted to heat in hot thermal store 400 where it is used in the power recovery cycle. When the load on the grid increases, charging apparatus 400 may be unloaded entirely or partially so that a greater portion, or indeed all of the power that is recovered by the power recovery apparatus 300 is exported to the grid. This provides a means to provide extra power to the grid on the sub-second timescale. For example, if the charging apparatus 600 is drawing 25 MW of power for 50 MW of power that is recovered by the power recovery apparatus, when the charging apparatus is unloaded, up to 25 MW of extra power can be exported to the grid near instantaneously. Conversely, when the load on the grid increases, charging apparatus 400 may be loaded further so that a greater portion of the power that is recovered by the power recovery apparatus 300 is consumed by the charging apparatus 600 and the power that is exported to the grid is reduced. Indeed, if the charging apparatus 600 is sized for the total power output of the power recovery apparatus 300, then the power exported to the grid may be as low as zero. Subsequently, the charging apparatus 600 may be unloaded partially or completely to so that more power is exported to the grid; for example, up to 50 MW more.

The skilled person will recognise that from the point of view of the electricity network, the above described operation constitutes fast frequency response, where the load received by the grid can be modulated on a sub-second time frame. FIG. 5 shows instantaneous step loading and unloading of the charging apparatus 600 with a substantial portion of the net power output of the power recovery apparatus 300. A skilled person will recognise that a continuous modulation of the portion drawn by the charging apparatus 600 is also possible. A skilled person will also recognise that in an analogous manner to the secondary operation shown in FIG. 4, the power recovery apparatus may be modulated slowly (on the seconds scale) and the charging apparatus may be modulated fast (on the sub-second scale).

By using the described charging apparatus 600 to draw the non-exported power from the power recovery apparatus 300, overall losses from the system are minimised.

As an additional benefit of providing a charging apparatus 600 (e.g. load bank) as described above, in an instance where the electrical connection between the cryogenic energy storage system 10 and the wider electricity network is lost, for example in the case of an abnormal event such as a trip of the main breaker, the power generated by the alternator 301 may be dissipated directly in the load bank system 600, preventing over-speed from occurring. A skilled person will recognise that, in this case, the load bank system 600 must be appropriately sized to dissipate the energy contained in the rotating shaft of the power recovery system 300.

The heating element 601 is typically disposed within the energy storage tanks (e.g. hot water tanks) in the thermal store 400. However, in an alternative embodiment, the heating element 601 may be disposed in a separate unit within the thermal store 400 such that a heat transfer fluid is heated as it flows through the separate unit.

The present invention has been described above in exemplary form with reference to the accompanying drawings which represent a single embodiment of the invention. It will be understood that many different embodiments of the invention exist, and that these embodiments all fall within the scope of the invention as defined by the following claims.

The invention claimed is:

1. A cryogenic energy storage system comprising:

a liquefaction apparatus for liquefying a gas to form a cryogen, wherein the liquefaction apparatus is controllable to draw power from an external power source to liquefy the gas;

a cryogenic storage tank in fluid communication with the liquefaction apparatus for storing cryogen produced by the liquefaction apparatus;

a power recovery apparatus in fluid communication with the cryogenic storage tank for recovering power from cryogen from the cryogenic storage tank by heating the cryogen to form a gas and expanding said gas;

a hot thermal store for storing hot thermal energy, wherein the hot thermal store and the power recovery apparatus are arranged so that hot thermal energy from the hot thermal store can be transferred to the high-pressure gas before and/or during expansion in the power recovery apparatus; and a charging apparatus which is controllable to draw power from the power recovery apparatus when the power that is recovered by the power recovery apparatus is above a threshold value, and supply the cryogenic energy storage system with thermal energy.

2. A system according to claim 1, wherein the charging apparatus is controllable to draw power from the power recovery apparatus when the power that is recovered by the power recovery apparatus is greater than a required power output of the system.

3. A system according to claim 1 or 2, wherein the power drawn by the charging apparatus from the power recovery apparatus is equal to or less than the power recovered by the power recovery apparatus.

4. A system according to claim 1, wherein the threshold value is a second threshold value, and wherein the charging apparatus is controllable to draw power from the external power source when the power drawn by the liquefaction apparatus is below a first threshold value, and supply the cryogenic energy storage system with thermal energy.

5. A cryogenic energy storage system comprising:

a liquefaction apparatus for liquefying a gas to form a cryogen, wherein the liquefaction apparatus is controllable to draw power from an external power source to liquefy the gas;

a cryogenic storage tank in fluid communication with the liquefaction apparatus for storing cryogen produced by the liquefaction apparatus;

a power recovery apparatus in fluid communication with the cryogenic storage tank for recovering power from cryogen from the cryogenic storage tank by heating the cryogen to form a gas and expanding said gas;

a hot thermal store for storing hot thermal energy, wherein the hot thermal store and the power recovery apparatus are arranged so that hot thermal energy from the hot thermal store can be transferred to the high-pressure gas before and/or during expansion in the power recovery apparatus; and a charging apparatus which is controllable to draw power from the external power source when the power drawn by the liquefaction apparatus is below a threshold value, and supply the cryogenic energy storage system with thermal energy.

6. A system according to claim 5, wherein the threshold value is a first threshold value, and wherein the charging apparatus is controllable to draw power from the power recovery apparatus when the power that is recovered by the power recovery apparatus is above a second threshold value, and supply the cryogenic energy storage system with thermal energy.

7. A system according to claim 4 or 5, wherein the charging apparatus is controllable to draw power from the external power source substantially instantaneously.

8. A system according to claim 1 or 5, wherein thermal energy generated by the liquefaction apparatus and/or a co-located process is transferrable to the thermal store.

9. A system according to claim 1 or 5, wherein the threshold value(s) are variable.

10. A system according to claim 1 or 5, wherein the power drawn by the charging apparatus is variable and/or the power drawn by the liquefaction apparatus is variable.

11. A system according to claim 1 or 5, wherein the power recovery apparatus comprises a pump for pressurising the cryogen before the cryogen is heated to form a gas and an expander for expanding the gas and/or the liquefaction apparatus comprises a compressor for compressing gas in a refrigeration cycle for producing cryogen.

12. A system according to claim 1 or 5, wherein the charging apparatus comprises a load bank and/or a resistive component.

13. A system according to claim 1 or 5, wherein the charging apparatus comprises a resistive coil or a resistive wire.

14. A system according to claim 1 or 5, wherein the thermal store utilises a heat transfer fluid and/or comprises one thermal storage vessel, at least one thermal storage vessel, or a plurality of thermal storage vessels.

15. A system according to claim 1 or 6, wherein the charging apparatus is configured to dissipate power generated by the power recovery apparatus when the power recovery apparatus is disconnected from an external power sink due to an abnormal event.

16. A system according to claim 1 or 5, further comprising a cold thermal storage system for storing cold recovered from the evaporation of cryogen to form gas and for transferring said cold to the liquefaction apparatus in order to reduce the energy requirements of liquefaction within the liquefaction apparatus.

17. A method of storing energy comprising:

providing a cryogenic energy storage system comprising:

a liquefaction apparatus for liquefying a gas to form a cryogen, wherein the liquefaction apparatus is controllable to draw power from an external power source to liquefy the gas;

a cryogenic storage tank in fluid communication with the liquefaction apparatus for storing cryogen produced by the liquefaction apparatus;

a power recovery apparatus in fluid communication with the cryogenic storage tank for recovering power from cryogen from the cryogenic storage tank by heating the cryogen to form a gas and expanding said gas;

a hot thermal store for storing hot thermal energy, wherein the hot thermal store and the power recovery apparatus are arranged so that hot thermal energy from the hot thermal store can be transferred to the gas before and/or during expansion in the power recovery apparatus; and a charging apparatus which is controllable to draw power from the power recovery apparatus when the power that is recovered by the power recovery apparatus is above a threshold value, and supply the cryogenic energy storage system with thermal energy.

18. A method of storing energy comprising:

providing a cryogenic energy storage system comprising:

a liquefaction apparatus for liquefying a gas to form a cryogen, wherein the liquefaction apparatus is controllable to draw power from an external power source to liquefy the gas;

a cryogenic storage tank in fluid communication with the liquefaction apparatus for storing cryogen produced by the liquefaction apparatus;

a power recovery apparatus in fluid communication with the cryogenic storage tank for recovering power from cryogen from the cryogenic storage tank by heating the cryogen to form a gas and expanding said gas;

a hot thermal store for storing hot thermal energy, wherein the hot thermal store and the power recovery apparatus are arranged so that hot thermal energy from the hot thermal store can be transferred to the gas before and/or during expansion in the power recovery apparatus; and a charging apparatus which is controllable to draw power from the external power source when the power drawn by the liquefaction apparatus is below a threshold value, and supply the cryogenic energy storage system with thermal energy.

19. A method according to claim 17 or 18, further comprising pressurising the cryogen using a pump before heating the cryogen to form a gas.

* * * * *